US005425158A

United States Patent [19]

Ripley

[11] Patent Number: 5,425,158

[45] Date of Patent: Jun. 20, 1995

[54] METHOD FOR PRODUCING A BLEACHED COTTON, NONWOVEN WEB

[76] Inventor: W. G. Ripley, 912 16th St., Lubbox, Tex. 79401

[21] Appl. No.: 116,740

[22] Filed: Sep. 7, 1993

Related U.S. Application Data

[63] Continuation-in-part of Ser. No. 950,272, Sep. 24, 1992, Pat. No. 5,253,392, which is a continuation-in-part of Ser. No. 612,558, Nov. 13, 1990, Pat. No. 5,199,134.

[51] Int. Cl.[6] ..... D01G 21/00

[52] U.S. Cl. ..... 19/66 CC; 19/66 R; 19/200; 19/98; 19/115 R; 19/145.5; 19/65 A

[58] Field of Search ..... 19/115, 98, 65 A, 65 R, 19/66 R, 66 CC, 80 R, 144, 145, 145.5, 145.7, 200, 201, 204, 205, 296, 302, 304, 297, 105, 0.27, 150, 151; 28/103, 104

[56] References Cited

U.S. PATENT DOCUMENTS

| | | | |
|---|---|---|---|
| 3,493,452 | 2/1970 | Cole | 19/296 |
| 3,802,030 | 4/1974 | Acree | 19/66 CC |
| 4,019,225 | 4/1977 | Nayfa | 19/66 R |
| 4,718,152 | 1/1988 | Suzuki et al. | 28/104 |
| 4,944,070 | 7/1990 | Girard et al. | 19/66 CC |
| 5,038,438 | 8/1991 | Gunter | 19/65 A |
| 5,155,989 | 10/1992 | Frey et al. | 19/65 A |
| 5,205,018 | 4/1993 | Leifeld et al. | 19/145.5 |
| 5,224,243 | 7/1993 | Schlepfer et al. | 19/205 |

*Primary Examiner*—Clifford D. Crowder
*Assistant Examiner*—Michael A. Neas
*Attorney, Agent, or Firm*—Henry S. Jaudon; Cort Flint

[57] ABSTRACT

A continuous textile processing system and method are disclosed for producing a non-woven web containing bleached cotton fibers in a single line system which includes a supply of fibers delivered from a bale opening device, a plurality of fiber delivery lines transport the fibers through a fiber preparation process and then through a fiber cleaning process where the fibers are individualized, opened, aligned and cleaned. A selective delivery system which is capable of moving the fibers through a multiple of stations during the precleaning process is provided. From the precleaning processes the fibers are processed into a fiber web and fed to a web stabilizing and bleaching apparatus which forms a stable bleached web. The bleached web is then passed through a drier unit. The dried bleached web is slit into a plurality of web strips or slivers which are fed to carding machines. The carding machines reform the fibers into a web which is hydroentangled and dried. The web is then rolled and readied for other processing. The final non-woven web, consisting of bleached cotton fibers, may be made into highly purified and absorbent wipes, pads, and other articles for medical, industrial, or domestic use.

37 Claims, 4 Drawing Sheets

METHOD FOR PRODUCING A BLEACHED COTTON, NONWOVEN WEB

This is a continuation in part of application Ser. No. 950,272 filed on Sep. 24, 1992, now U.S. Pat. No. 5,253,392, which is a continuation in part of application Ser. No. 612,568 filed Nov. 13, 1990, now U.S. Pat. No. 5,199,134, issued on Apr. 6, 1993.

BACKGROUND OF THE INVENTION

The invention relates to a continuous, fully integrated system and method for producing nonwoven webs consisting of bleached cotton fibers.

Bleached cotton fibers have been used in many nonwoven fabric applications for cleanliness and absorbency such as wipes, pre-moistened towelettes, absorbent pads, etc. The purified, absorbent fibers are particularly advantageous in hospital and medical applications such as disposable sheets, blankets, gowns, and bandages, and, particularly, because of their biodegradability. Typically the bleached cotton fibers are made into a nonwoven web and then fabricated for the particular end use.

The typical process has included many separated processing steps. Typically, raw cotton fibers are bleached at a remote bleachery using a large vat. The bleached fibers are dried and pressed into bales. The bales of bleached cotton fibers are then transported to a textile mill at another location where they are processed further by a nonwoven carding system into nonwoven webs in a conventional manner. ,Bleaching processes have not been a part of nonwoven textile processing lines. As a result, the textile process has been fairly inefficient incurring transportation costs, and inefficiency through piecemeal processing.

Various textile process lines for woven and nonwoven fabrics are known and have been proposed in the past. Various processes and systems are known for opening, cleaning, and blending fibers, for example, U.S. Pat. No. 2,718,671. Various processes and systems for opening fiber bales, and opening and cleaning the fiber before being carded into a web for woven or nonwoven applications are known, for example, as shown in U.S. Pat. No. 4,535,511.

It is known to make webs formed from synthetic fibers more integral by hydroentanglement techniques. Various hydroentanglement techniques and apparatus for producing integral webs having various patterns are shown in U.S. Pat. Nos. 3,494,821; 3,486,168; 3,485,706; 3,508,308; and 3,493,462.

Because of the increased demand for the bleached cotton fiber, for both woven and nonwoven products, it has become necessary to use lower grades of cotton. This has rendered the prior bleaching and textile processes unsatisfactory because they do not satisfactorily process the lower grade of cotton. Accordingly, an important object of the present invention is to provide a system and method for producing bleached cotton, nonwoven webs in a single processing line under one roof.

Another object of the invention is to provide a continuous fiber preparation process capable of converting low grade, dirty, short stable cotton fibers into a clean blended fiber web.

Another important object of the invention is to provide an efficient textile process system and method which begins with the opening of raw cotton fibers from bales and ends with the production of nonwoven webs ready to enter a cotton bleaching process in a continuous system.

Another object of the invention is to provide a continuous cleaning cotton system which dries the cotton fibers prior to cleaning so as to more efficiently and effectively remove trash and dirt particles.

Another object of the invention is to provide a continuous cotton cleaning system capable of adapting between extremely dirty cotton and mildly dirty cotton.

Another object of the invention is to provide a textile processing system and method wherein low grade raw cotton fibers may be processed and bleached and the bleached fibers may be subjected to further processing and production of a nonwoven web and prepared for further textile processing.

Another object of the invention is to provide a cotton processing system capable of producing cleaned and bleached cotton at an extremely high yield.

Another object of the invention is to provide a cotton processing system which reduces the cost per pound of processing clean and bleached cotton.

Another object of the invention is to produce surgical grade cleaned and bleached cotton at a rate of at least three to four thousand pounds per hour.

Another object of the invention is to provide a system which fully cleans and blends low grade cotton for the formation of cotton webs to be bleached.

SUMMARY OF THE INVENTION

A continuous fiber processing system for producing a bleached and blended cotton fiber web beginning with bale opening means for opening bales of cotton fibers and delivering the fibers to a plurality of fiber feed lines each of which includes a first fiber opening means for individualizing and cleaning the fibers to produce cleaned opened fibers. From the opening means the fibers move to a fiber preparation station which includes a fiber heating unit and a metal removing unit for collecting the opened fibers and preparing them for blending, cleaning and web forming. Conveyor means deliver the fibers from the preparation station to a precleaning station. The precleaning station cools, cleans and re-heats the fibers for presentation to the primary cleaning and web forming station. The primary cleaning and web forming station further cleans, blends and forms the fibers into a web. The fiber web is delivered to a cross-blending station which prepares the web for delivery to the bleaching station.

The pre-cleaning station includes a horizontal cleaning machine which allows the fibers to cool and also inclined cleaning machines.

The primary cleaning and web forming station includes a stick and large trash removing machine, inclined cleaning machines, micro dust removing machines, double battery comber machines and in line comber,machines.

Switching means are provided which allow the precleaning and conditioning station to be by passed.

The heating means include vacuum chambers which introduce the fibers into the transport system which conveys the heated fibers to the pre-cleaning and conditioning station and to the primary cleaning and web forming station. The fibers are heated to between one and six million BTU's.

Bale forming devices are arranged to receive and bale removed dirt and lint.

The primary cleaning and web forming station includes a web divider which separates the web to feed simultaneously the double battery combing machines.

The bleaching station further stabilizes the web and delivers it to a continuous flow bleaching system which bleaches the fibers forming the web producing a web of bleached cotton fibers. From the bleaching system, the web is fed into a dryer system for drying. From the dryer system the now dried bleached web goes to a slitter which slits same into a plurality of web strips or slivers. The slivers are fed to a plurality of carding machines which further blend and clean the fibers and also forms them into a loose web. The loose webs are delivered to a common conveyor means in stacked overlaying fashion forming a stacked web. The common conveyor delivers the stacked bleached web to a second web stabilizing means in the form of a hydroentangling system which produces a stable web of entangled fibers. The stable web is passed to a dryer mechanism and from there to roll forming means wherein it is a rolled web for use in further fiber processes.

To obtain additional blending web cross-lapping means may be arranged to receive the non-woven webs from the carding machines. This arrangement forms a cross-lapped web having a plurality of web layers.

The first web forming means preferably consist of comber machines which produce a blended web prior to bleaching.

The first dryer system comprises a foam dryer for receiving and treating the bleached web from the fiber bleaching means and a web drying oven for receiving the web from the foam drying means. Also, there may be included apparatus for applying an additive to the bleached cotton fibers before they are dried as they exit the fiber bleaching means. Additionally, means for dying the bleached and hydroentangled web a desired color may be provided.

An alternative arrangement comprises a fiber processing system which includes bale openers connected to deliver opened fibers to a fiber preparation station as in the primary embodiment.

A routing system is connected with the fiber preparation station and is controlled to deliver the fibers through a myriad of routes to a fine cleaning station.

The routing system may be connected to deliver the prepared fibers to a primary cleaning station or to only a portion of the primary cleaning station. The fibers may or may not be routed to be dried before being sent to the primary cleaning station. Also, the fibers may or may not be routed through a stick and leaf remaining chamber prior to being sent to the primary cleaning chamber.

From the primary cleaning station, the fibers are fed into an auger conveyor which is connected to a plurality of inclined feed stations of a plurality of carding machines. The auger conveyor includes a re-circulating system which allow for any excess of fibers to be re-circulated through the auger conveyor.

Suction take-off means remove the carded fibers, still in fiber form, from the carding machine and deliver them to a conveyor which is connected with further processing mechanisms of the type utilized with the primary embodiment.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
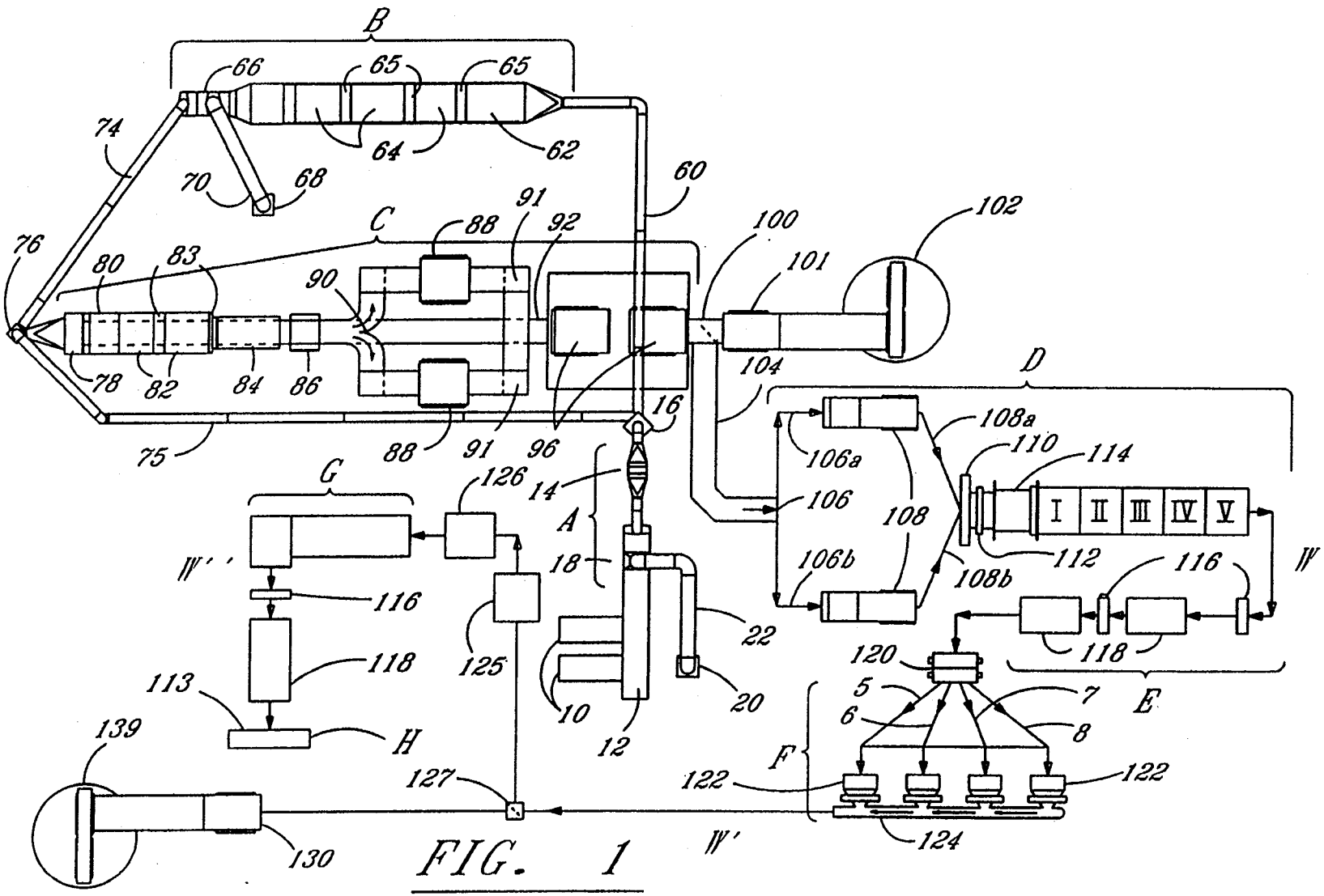
FIG. 1 is a schematic view illustrating a textile processing system and method for producing a non-woven web of cleaned cotton, prepared for delivery to a bleaching operation in a single and continuous processing line.

Referring now in more detail to the drawings, a system and method for producing a nonwoven web of cleaned and bleached cotton fibers will be described. The system begins with a delivery line which is connected with at least two bale openers 10 which may be any suitable and known type such as a HF6012 hopper feeder manufactured by Hollingsworth, Inc. of Greenville, S. C. Bale openers 10 are each capable of opening up to four bales per hour. Fibers from bale openers 10 are discharged onto a mechanical conveyor 12 and delivered to a fiber preparation station A which includes a preheating chamber 18 which removes moisture from the fibers and readies them for particle and dust removal. The fiber preparation station A also includes a metal removing unit 14 which cleans and removes metal and begins the process of opening and further individualizing the heated fibers. Any suitable metal removing unit may be used such as those manufactured by Continental, Hollingsworth or Lumas. Fibers are conveyed from metal remover 14 into y-valve 16 which controls the additional cleaning and web forming processes from between an intensive cleaning process and a super intensive cleaning process.

Heated air is generated at a heat source 20 and delivered through conduit 22 to heating unit 18 with an air flow which may range between 5,000 and 15,000 CFM, however an air flow of 10,000 CFM is preferred. The air is heated to between 1 and 6 million BTU's with air heated to 4 million BTU being preferred.

Figure 3:
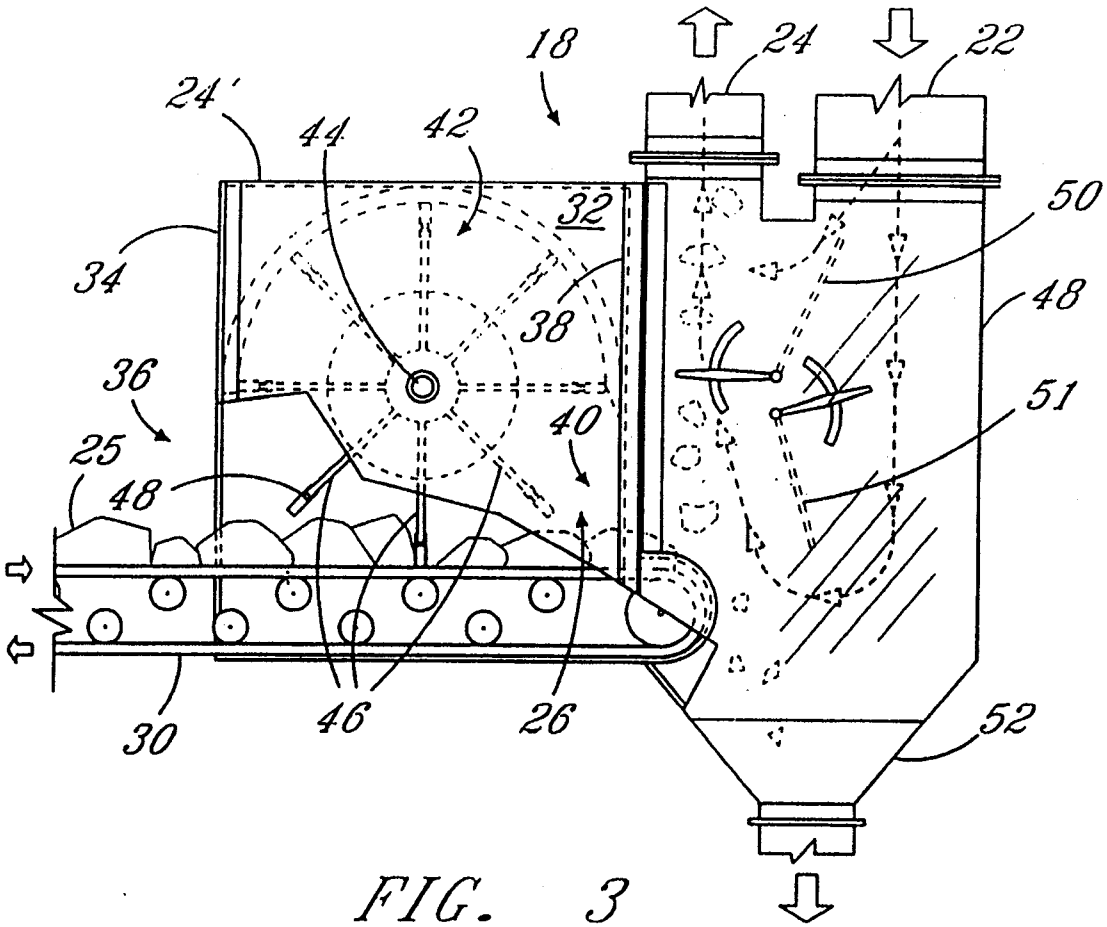
FIG. 3 is a sectional side view of the preheating chamber.
Figure 4:
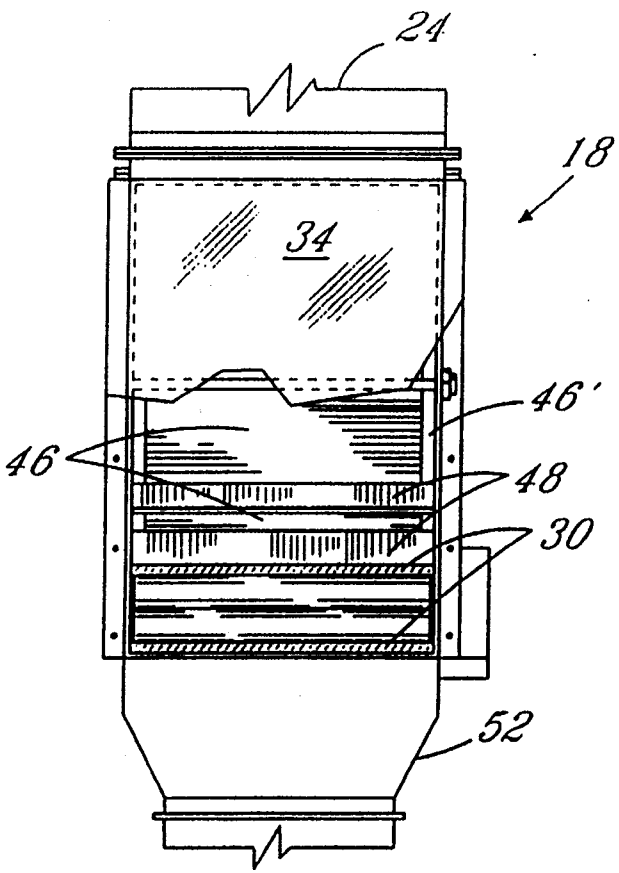
FIG. 4 is a sectional end view of the preheating chamber taken from the left side of FIG. 3.

FIGS. 3 and 4 show in detail the structure of heating chamber 18. The opened cotton fibers 25 are fed by conveyor belt 30 into vacuum unit 24'. The vacuum unit consists of a pair of sides 32 which are solid, a front wall 34 which has a feed opening 36 and a rear wall 38. A fiber exit opening 40 is formed at the lower end of wall 38. Conveyor belt 30 is of a width substantially equal to the width of vacuum chamber 24.

A vacuum chamber forming paddle wheel 42 is rotably driven about axis 44. Paddle wheel 42 includes a plurality of equally spaced paddles 46 each equipped with a resilient flapper 48 at its end. Paddles 46 are provided at their edges with a seal 46' and are of a width substantially equal that of vacuum unit 24'.

Mounted adjacent vacuum unit 24' is a mixing and cleaning chamber 48. Mixing and cleaning chamber 48 includes a connection for conduit 22 which emits the heated air into the chamber. Vanes 50, 51 control the passage of air through chamber 48 and out the exit conduit 24. The lower portion of chamber 48 contains a trash collecting sump 52 which connects with a trash collector not shown.

Pre-heating chamber 18 receives the opened cotton fibers 25 from opening machines 10 by conveyor 30. As the fibers enter unit 24' paddle wheel 42 which is rotating in the direction of and at the same speed as conveyor belt 30 engages with the conveyor belt. The opened fibers are separated into individual bundles by the paddles 46 as paddle wheel 42 continues to move toward exit opening 40. The paddles 46, through the engagement of seals 46' with side walls 32 and the engagement of flapper 48 with conveyor belt 30 form moving vacuum chambers, which prevent the escape of the heated air and which carry the fibers and deliver them into mixing and cleaning chamber 48 through opening 40. One of the moving chambers is shown at 26 and is formed between paddles 46".

The heated air passes through conduit opening 22 with the flow following the arrows as indicated in FIG. 3. As the air passes under lower vane 51, it engages with the fibers entering through opening 40. Paddles 46 prevent the air from exiting chamber 26 through opening 36. As the heated air engages, dries, and lifts the fibers which are being delivered through opening 40, large trash particles drop out into sump 52. The fibers become entrained in the air flow and are transported out of chamber 48 through the opening connecting with conduit 24.

Vanes 50 and 51 are pivotal about axis 53 to move between extreme open and closed positions. When vane 50 is positioned in its extreme left most position, it prevents substantially all of the air flow across the upper part of chamber 48 between openings 22 and 24. When vane 50 is in this position vane 51 must be positioned in its extreme right position. This allows the air to flow through the opening formed between the end of vane 51 and the end of conveyor belt 30. Vanes 50 and 51 are adjusted relative to each other to allow air of sufficient volume to pass below vane 51 and engage with the fibers to heat, clean and convey them. When vane 50 is moved to the right, a portion of the incoming air passes over the upper end of the vane and directly out conduit 24 as shown by the arrows in FIG. 3. This requires that the opening between vane 51 and conveyor belt 30 be made smaller so that the air moves through the opening with sufficient force.

Conduit 24 conveys thee heated fibers into the metal removing station 14. From this station the fibers pass to y valve 16.

If it is necessary that a super intensive cleaning operation be conducted, valve 16 directs the heated fibers carried by the heated air into conduit 60 which delivers them to a pre-cleaning operation B. The pre-cleaning station includes a horizontal cleaner 62 into which the fibers are delivered by conduit 60. In line with and adjacent to the horizontal cleaning machine 62 are a plurality of inclined cleaners 64. Both horizontal cleaner 62 and inclined cleaners 64 deliver the processed fibers to drops 65 which direct them to the next processing station. It is preferred that three in line inclined cleaning machines 64 which are inner connected via drops 65 and fed from a horizontal cleaner 62 function to clean, condition and blend the fibers. This arrangement allows the fibers to cool. Therefore, upon leaving the last inclined cleaning machine 64, the fibers are again passed through a heating station 66 which is similar to heating station 18.

Heat source 68 delivers heated air through conduit 70 into heating station 66 where it further heats, blends, cleans and conveys the fibers into and through conduit 74. Conduit 74 terminates with y valve 76.

Primary cleaning and web forming station C receives the heated, conditioned and cleaned fibers through valve 76. Primary cleaning and web forming station C begins the fiber preparation process with stick and large trash removing machine 78 which again cleans the fibers of large particles. From cleaning machine 78 the fibers are delivered to a comber machine 80 which cleans the fibers and forms them into a batt. The fiber batt is delivered to the first of a series of in line inclined cleaners 82 which break up the fiber batt and further blend and clean the fibers. To assist in keeping the fibers separated for cleaning, each of the inclined cleaners 82 delivers the fibers into a fiber drop 83 which allow fiber free fall before delivery to the next machine. Following the inclined cleaning machines is a fine trash removal machine 84 followed by a micro dust removing machine 86.

The fiber batt upon leaving the micro dust remover 86 is passed through a splitter 90 which divides the web into two parts. Adjacent to splitter 90 is a double battery comber 88. The divided webs are delivered into double battery comber 88 where they are combed and formed into webs. The webs are delivered onto conveyor 91 which stacks them in vertical fashion on conveyor 92. Conveyor 92 delivers the stacked web into the first of the in line combers 96 where the fibers are again combed and formed into a single web.

The web is passed from the last of comber machines 96 to y valve 100. This y valve is connected in one direction with a condenser 101 which condenses the web and delivers it to a baler 102 which forms a bale of the fibers for storage before further processing.

Alternatively, y valve 100 connects with conduit 104 which delivers the fiber web to further processing machinery.

Should the fibers require only intensive cleaning valves 16 and 76 are controlled to direct the heated fibers leaving the fiber preparation station A through conduit 75 and directly into the primary cleaning and web forming station C.

Each of the cleaning and combing machines of the system is of known construction and is readily available from the various machine manufacturers such as American Treutzschler, Inc. of Charlotte, N. C.; Continental Eagle Corp of Prattville, Ala.; Consolidated Engineering of Kennesaw, Ga.; Hollingsworth on Wheels of Greenville, S. C. and Leemar Corp of Columbus, Ga. The machine structures form no part of the instant invention.

Conduit 104 connects with a switch box 106 which divides the web between the cross blenders 108 or it may act to switch the web back and forth in a selected sequence between the cross blenders 108. The number of blenders 108 is determined by the volume of fibers being fed. Cross blenders 108 may be any suitable fiber blenders such as LCB lay down cross blenders manufactured by Hollingsworth, Inc. The cross blenders blend the fibers while providing some fiber opening, and act as a reserve to feed bleach feeding lines **108*a*, 108*b*. The fibers coming out of the bleach feeding lines are conveyed to flow distributor 110 which acts to equalize the fiber flow and to deliver a constant uniform fiber flow to chute feeder 112. Chute feeder 112 may be of any suitable design such as that disclosed in U.S. Pat. No. 4,657,444. The fibers pass into chute feeder 112 at its upper end and are condensed into a uniform fiber mat by means of air and mechanical movements. A fiber web is delivered from chute feeder 112 to hydroentangling unit 114. Hydroentangling unit 114 acts to entangle and interlock the fibers of the web together to form a stable web of highly entangled fibers capable of retaining its integrity as it passes through bleaching unit D. Plural blenders are used because the bleaching unit has a capacity of at least 4000 pounds per hour, and each blender has a capacity of about 2500 pounds per hour. Hydroentangling unit 114 may act on the top, the bottom, or both the top and bottom of each web W. Hydroentangling unit 114 has a capacity in excess of 4000 pounds per hour, thereby allowing the plural cross blenders 108 and bleaching unit D to operate at or near capacity. Switch box 106 switches the fibers between lines 106***a*, 106*b*.

The web moves through the bleaching unit via a plurality of bleaching chambers I, II, III, IV, and V via a plurality of rolls (not shown) and is immersed in various bleaching agents. The bleaching agents in the various chambers may be one or a combination of alkali impregnation, alkali steam reaction, alkali reuse, bleach impugn, bleach steam, or bleach venue. A suitable bleaching unit D is a continuous flow bleaching unit manufactured by Greenville Machinery of Greenville, S. C. The bleaching unit bleaches the fibers as they continuously flow through the bleaching unit in web form. A bleached fiber web W leaves bleaching unit D and passes into dryer system E. Dryer system E may include foam dryer 116 which applies a flame or mildew retardant to the fibers while still wet. The web may then pass to a gas dryer 118 which can be a conventional gas fired textile oven operating at necessary speed and temperature to accommodate 4000 pounds per hour of fiber web. Dryer 118 may completely dry web, in which case the web passes directly to slitter 120. Optionally, web W may be partially dried and passed to a second foam dryer 116 which also dyes the web a solid color. From dryer 116, web W passes into a second gas dryer 118 where drying is completed. Dried web W passes now to slitter 120 which slits the web into a plurality of web strips or slivers 5, 6, 7, 8. Slivers or web strips 5, 6, 7, 8 are each delivered to a carding machine 122 by delivery lines. There are four card machines 122 shown; however, the number is increased or decreased depending upon the fiber pounds per hour delivered from slitter 120. Also, the number of slitters 120 may be increased if necessary. Each card 122 delivers a fiber web to mechanical conveyor 124 where the carded fibers are lapped or stacked so as to again further blend the bleached fibers. The carded webs formed from web strips 5, 6, 7, 8 are now formed into bleached and stacked web W'. It is noted that the carding process performed by carding machines 122 removes trash, micro dust, and fibers which are too short. Cards 122 perform the final opening and cleaning operation for the fibers prior to their being delivered for further product processing. The carded webs are doffed by air from conveyor 124 and carried to an additional card 125 which delivers the fibers to cross lapped machine 126. The bleached cross lapped cotton web W' is then fed to a hydroentanglement unit G which intermingles and interlocks the fibers together in an integral web W" of bleached cotton fibers. After drying by dryers 116 and 118, web W" is formed into a roll 113 on take-off mechanism H and is in condition to be handled for further applications or to be fabricated into various end products.

A suitable hydroentanglement unit is manufactured by Honeycomb Systems of Maine. As the web enters the hydroentanglement unit, it encounters a series of very fine water jet units that pierce the carded web and cause the fibers to be intermingled and interlocked. This action holds the web together. Hydroentanglement is a rather unique process which provides softness and the drapeability to the web, and a generally lint free web. The finished product is dirt, dust, and lint free, and therefore, can be used in a lot of advantageous applications, such as with instruments or electronics, in hospitals, and other non-woven markets.

The processed and carded web of opened cleaned bleached fibers W' may be directed through Y valve 127 to bale press 139. A condenser 130 assembles the opened bleached fibers to be compressed into a bale. These bleached fibers can be sold in bale form.

Figure 5:
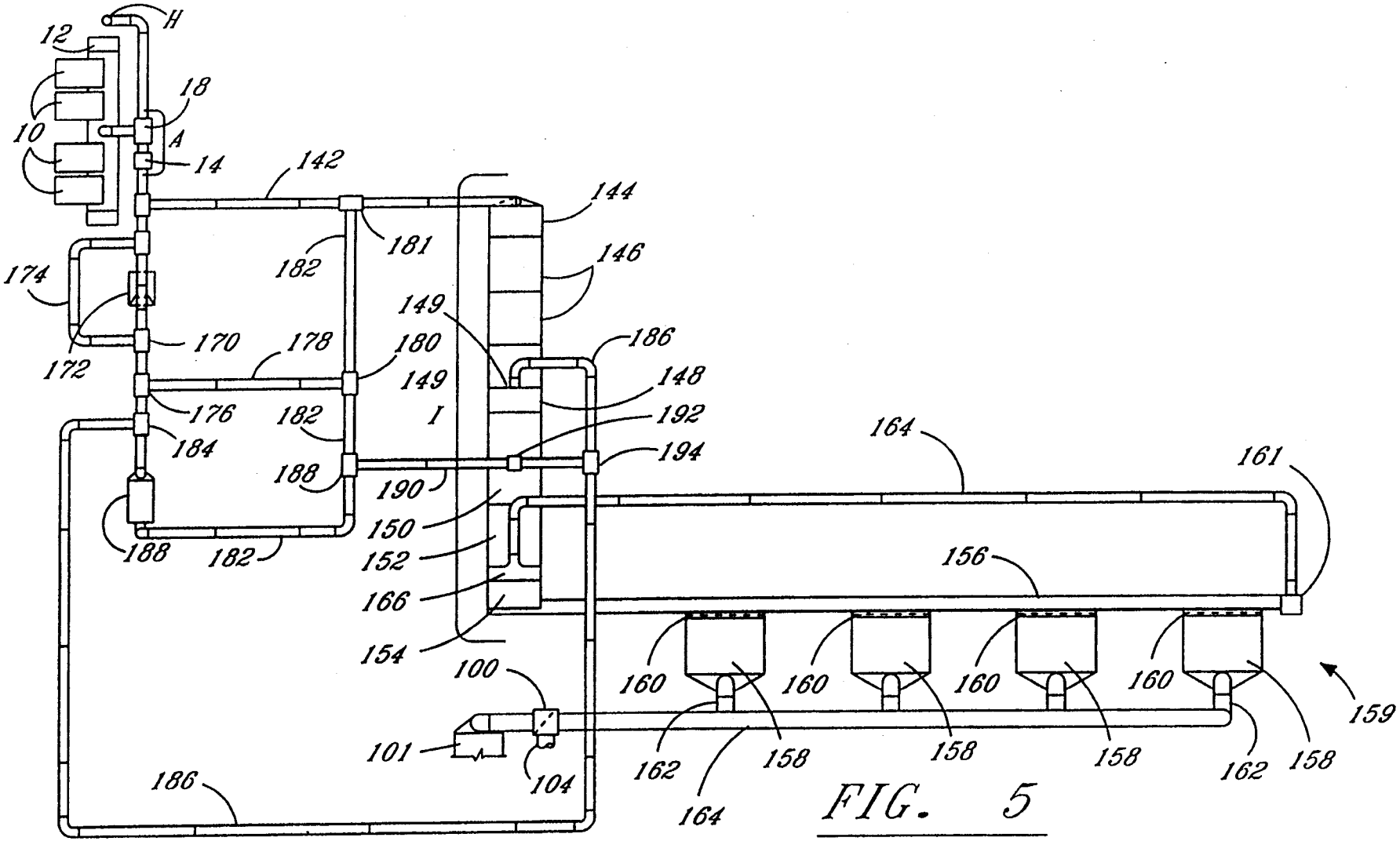
FIG. 5 is a schematic view illustrating an alternative arrangement for a pre-bleaching cotton opening, cleaning and blending processing system.

An alternative arrangement for preparing cotton fibers for further treatment is shown in FIG. 5. In this arrangement openers 10 again open and separate cotton fibers from bales and deliver these fibers into a chute feed 12 which delivers them to a fiber preparation unit A. The number of openers 10 is totally dependent upon needs of the remainder of the system and the capacity of each opener.

From fiber preparation area A, the fibers are conveyed by hot air through a conduit which connects with a Y valve 140. A conduit 142 leading from valve 140 connects with a primary cleaning area I.

Primary cleaning area I consist of a condenser 144 which condenses the heated fibers and delivers them into the first of a series of at least three inclined cleaners 146 which act to blend and separate the condensed fibers allowing dust, dirt and foreign objects to be drawn away. Following this series of inclined cleaners 146 another condenser 148 is arranged to again condense the fibers before feeding them into a final inclined cleaner 150. Inclined cleaner 150 delivers the cleaned fibers into an even feed machine 152 which evenly delivers the fibers to a condenser 154.

A fine cleaning section J which includes a fiber feed apparatus comprising an auger conveyor or screw conveyor 156 is arranged to receive the condensed opened and cleaned fibers from condenser 154. Auger conveyor 156 is of usual construction consisting of an elongated tube or casing in which rotates an elongated screw. Arranged along the length of and connected with auger convey 156 are a series of carding stations 159, to be hereinafter described in detail.

The cleaned fibers are delivered into the auger feed from condenser 154 and are moved along the length thereof in the direction of the arrow towards overflow 161. Chute feed systems 160 are connected with auger Conveyor 156 and are adapted to receive the opened and cleaned cotton fibers through openings in the auger casing. Should the volume of cleaned and opened fibers exceed the capacity of Chute feeds 160, auger 156 simply pushes these fibers out of its opposite end and into overflow bin 161. An air current removes the excess fibers from the overflow and carries them through conduit 164 back to overflow separator 166 which recirculates the fibers back into condenser 154 where they are recirculated through auger conveyor 156.

Carding stations 159 consist of a chute feed 160 which receives fibers from auger conveyor 156 and delivers them into carding machines 158. It should be noted that each carding machine can process up to 1600 lbs per hour and that the number of carding stations 159 in the system is variable dependant upon the capacity of the further processing system.

The carding machines 158 receive opened and air born fibers from the chute feed 160, and card and align the fibers to remove particles and to allow micro dust to fall away. The carded product is drawn away from carding machines 158 by pneumatic suction members 162 which remove the carded fibers from the carding machines and deliver them into conduit 164 as loose fibers. Conduit 164 is connected with Y valve 100 which as earlier described is connected with conduit 104 which delivers the fibers to a further processing systems such as one having stations D, E, F, and G shown in FIG. 1. Valve 100 is also connected with condenser 101 which delivers the fibers to a baler such as 102 of FIG. 1.

Between preparation station A and five cleaning station J are many variable routes through which the heated and opened fibers may be passed. The route selection is made in dependence upon the quality, to include cleanness, of the baled cotton and the intended end use for the processed cotton fibers. A very high grade of clean cotton fibers clearly do not require an intensity of cleaning as do fibers from lower grade and less clean bales.

The fibers leaving preparation station A move through valve 140 which is normally connected with conduits 142 as previously described. Should either additional or less cleaning be desirable, valve 140 is opened to connect with conduit 168.

Valves 170 arranged on each side of drying chamber 172 receive fibers through conduit 168 and delivers them to or around the drying chamber via conduit 174.

Conduit 178 connects with conduit 182 via valve 176 which is arranged adjacent to but beyond valves 170 and is also connected with conduit 178 and via valve 180. Valve 176 also is connected with valve 184. Valve 184 in one position is connected with stick and leaf removing and opening chamber 188 and in its other position with conduit 186.

Chamber 188 delivers fibers into conduit 182 which is connected to conduit 190 by valve 188', to conduit 178 by valve 180 and to conduit 142 by valve 181.

Conduit 190 is connected with even feed 150 of primary cleaning station I by valve 192 and with conduit 186 by valve 194. Conduit 186 is also connected with condenser 148 at 149 of primary cleaning station I.

Fibers leaving preparation station A may be sent through a myriad of cleaning combinations because of the network of conduits and valves as described above. This gives the cleaning system a maximum of flexibility to handle cotton fibers of a wide range of staple lengths and degree of cleanness and to produce a product cleaned to the degree desired.

A few examples of fiber routes after leaving preparation station A will now be described. The fibers normally leave station A and pass to primary cleaning unit A via conduit 142. Extra cleaning may be provided by passing the fibers first through drying chamber 172, stick and leaf cleaner 188 and then to primary cleaning unit I via conduits 182, 142 using valves 188', 180 and 181. Only a portion of primary cleaning unit I may be used by selecting to deliver the fibers through conduit 190, 186 and to primary cleaner I at 149. Even less of the primary cleaning unit may be used by moving the fibers through conduit 190 and directing them into even feed 150 by valve 192.

It is noted that no matter the degree of primary cleaning selected, the fibers are always fed from the primary cleaning station I to the fine cleaning station J.

Again, the various fiber processing machines are of themselves old and may be purchased from various manufacturers as earlier noted.

Figure 2:
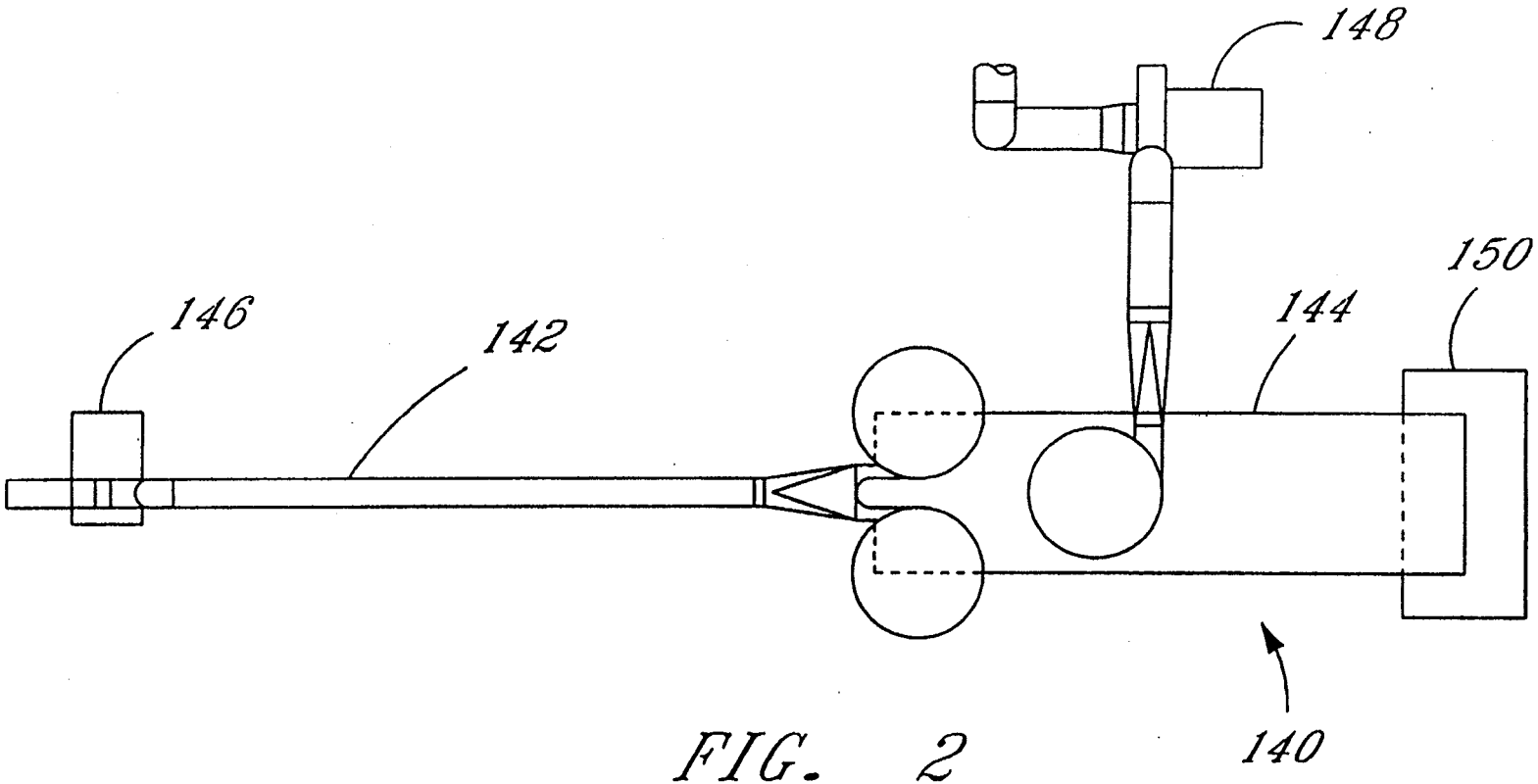
FIG. 2 is a schematic view illustrating a waste collecting and baling arrangement.

Turning now to FIG. 2, a waste receiving and baling system 140 is shown. This baling system is designed to receive the waste fibers, dust and dirt from the various sumps associated with the many processing and cleaning stations A, B, C, D, E, F, I and J.

Waste baling station 140 is provided with a conduit 142 which receives waste from the various cleaning stations, delivers it to an inclined cleaner 144. A trash removing fan 146 is connected with conduit 140 to remove heavy trash prior to delivery to cleaner 144. A dust removal section 148 draws air born fibers and dust from the cleaners as the fibers are delivered to a press on baler 150. The baled trash fibers have a use in industrial cleaning.

While preferred embodiments of the invention have been described using specific terms, such description is for illustrative purposes only, and it is to be understood that changes and variations may be made without departing from the spirit or scope of the following claims.

What is claimed is:

1. A continuous fiber processing system for producing clean, bleached and blended fibers comprising:

bale opening means for opening bales of cotton fibers;

fiber preparation means for receiving fibers from said bale opening means;

a primary cleaning and web forming station for receiving fibers from said fiber preparation means, said primary cleaning and web forming station including a plurality of in line cleaning machines which sequentially clean the fibers and form said fibers into a batt;

separating means arranged in line with said primary cleaning and web forming station which acts to separate said batt into a plurality of batts;

first comber means arranged to each receive a batt, said first comber means forming said batts into webs;

second comber means arranged adjacent said first comber means said second comber means acting to blend said webs into a single blended web;

continuous flow bleaching means for receiving said web of cleaned and blended fibers, said bleaching means producing a web of bleached cotton fibers;

a first dryer system for drying said web of bleached fibers;

slitter means receiving said bleached and dried web and slitting same into a plurality of slivers;

additional blending means including carding machines receiving said slivers of bleached fibers from said web slitting means and producing a plurality of carded webs;

common conveyor means receiving said carded webs of bleached fibers in stacked overlaying fashion, said common conveyor delivering said stacked bleached web to web stabilizing means;

said web stabilizing means acting to produce a stable web of bleached and entangled fibers;

a second dryer system receiving and drying said stabilized bleached web; and roll forming means receiving said dried, bleached web and forming a rolled web for use in further fiber processes.

2. The system of claim 1 wherein said fiber preparation means includes a heating unit for heating said opened fibers prior to said cleaning and web forming operations.

3. The system of claim 1 including hydroentangling means arranged between said second comber means and said bleaching means.

4. The system of claim 3 including a blending station, which comprises a plurality of cross blending units and a switch box operative to selectively deliver said opened fibers from a common point to either of said cross blending units for further blending, arranged between said second comber means and said hydroentangling means.

5. The system of claim 1 wherein said multi-blended web passes through hydroentangling means for entangling and interlocking said fibers together to produce an integral web of multi-blended cotton fibers.

6. The system of claim 1 wherein said web stabilizing means includes a second hydroentangling means for receiving said carded web, said hydroentangling means acting to entangle and interlock said fibers of said web together to provide a stable web of bleached cotton fibers.

7. The system of claim 1 wherein said first dryer system includes a foam drying means for receiving and treating said bleached web from said fiber bleaching means and a web drying oven for receiving said bleached and treated web from said foam drying means.

8. The system of claim 1 wherein said first dryer system comprises at least one foam dryer unit and at least one drying oven unit, said units being arranged in sequence.

9. The system of claim 1 wherein said fiber preparation means includes a metal removal chamber.

10. The system of claim 1 including cross lapping means receiving and cross lapping said carded webs of bleached fibers, said cross lapping means delivering said carded and cross lapped webs to conveying means where said webs are stacked one on the other forming a multi-layered web.

11. The system of claim 1 wherein said cleaning machines include at least a large trash removing machine, an inclined cleaning machine, a fine trash removal machine and a dust removal machine.

12. The system of claim 2 wherein a pre-cleaning and conditioning station is arranged between said fiber preparation station and said primary blending and cleaning station.

13. The system of claim 12 wherein said pre-cleaning and conditioning station includes horizontal cleaning machines and inclined cleaning machines.

14. The system of claim 13 wherein said heated fibers are allowed to cool during cleaning in said horizontal cleaning machine.

15. The system of claim 14 wherein said pre-cleaning and conditioning station includes a second heating station.

16. The system of claim 15 wherein means deliver said pre-cleaned and reheated fibers from said pre-cleaning and conditioning station to said primary cleaning and web forming station.

17. The system of claim 2 wherein said heating station includes a condenser chamber having a plurality of heating cells.

18. A continuous fiber processing system for producing clean and blended cotton fibers comprising:

bale opening means;

fiber preparation means including fiber heating means and a metal removing cleaning station;

a pre-cleaning station which includes a plurality of fiber cleaning machines which clean, blend and allow the heated fibers to cool and a second fiber heating means;

a primary cleaning and web forming station which includes a second plurality of fiber cleaning machines which clean and blend said heated fibers, dust removal means which remove airborne fiber and dirt, and a plurality of comber machines which further blend said fibers and form said fibers into a web;

further processing means for further processing said blended and cleaned fibers; and delivery means interconnecting said bale opening means, fiber preparation means, pre-cleaning means, primary cleaning and web forming means and further processing means.

19. The system of claim 18 wherein said further processing means comprises a bale forming station which receives and forms into bales said web of cleaned blended fibers.

20. The system of claim 18 wherein said further processing means includes a cross blending station, a hydrogenerating station and a bleaching station.

21. The system of claim 18 wherein said bale opening means comprises a plurality of bale opening machines each capable of opening up to four bales per hour.

22. The device of claim 18 wherein said heating means includes a vacuum chamber which receives opened fibers in individual vacuum chambers connected with a heating chamber and means connected with said heating chamber pass heated air through said heating chamber to engage with said fibers to heat and remove moisture and to carry said fibers from said heating unit.

23. The device of claim 22 wherein said individual vacuum chambers are formed by a rotating paddle wheel which forms said individual chambers to move across said heating unit.

24. The device of claim 22 wherein said air is heated to between one (1) and six (6) million BTU's.

25. The system of claim 18 where said system is capable of processing cotton fibers at a rate of at least six thousand pounds per hour.

26. The system of claim 18 wherein said fiber cleaning machines of said pre-cleaning station includes a horizontal cleaning machine and a plurality of inclined cleaning machines.

27. The system of claim 18 wherein said primary cleaning and web forming station includes a large trash removing machine, an inclined cleaning machine, a dust removing machine and a plurality of comber machines.

28. The system of claim 18 wherein said comber machines include a double battery comber and splitting means to divide the fiber batt between said double battery comber.

29. The system of claim 28 wherein said comber machines include in line comber machines which receive said webs formed by said double battery comber means and further blend the fiber webs to form a single fiber web.

30. The system of claim 18 wherein said delivery means which receives said fiber web from said comber machines include a valve operable to select delivery of said fiber web between a baling station and a bleaching apparatus.

31. The system of claim 18 wherein a waste baling station is provided to receive and bale said removed trash, dust and fibers.

32. The system of claim 18 wherein said delivery means delivering said fibers from said fiber preparation means to said precleaning and conditioning station and to said primary cleaning and web forming station comprise hot air conduits.

33. The system of claim 32 wherein the air flow within said hot air conduits is between 5,000 and 15,000 CFM.

34. The system of claim 18 wherein said bale opening means comprise at least two bale opening machines arranged to deliver opened fibers onto a delivery belt in stacked manner to blend said opened fibers.

35. The system of claim 18 wherein said delivery means includes a direction valve capable of selectively directing said fibers from said fiber preparation means between said pre-cleaning station and said primary cleaning and web forming station.

36. A method of continuously processing cotton fibers to produce clean and blended cotton fibers, said method including:

presenting bales of fibers to bale opening means and opening said fibers forming said bales;

delivering said fibers to fiber preparation means wherein said fibers are heated and passed through a metal removing cleaning station;

delivering said heated fibers to a cleaning and web forming station which includes a plurality of fiber cleaning machines which clean and blend said heated fibers while allowing them to cool while removing dust, airborne fibers and dirt said web forming station also combs said fibers to further blend said fibers and form said fibers into a web;

delivering said fiber web to a further processing station for further processing of said blended and cleaned fibers said further processing station including a cross blending section, a hydrogenerating section, a bleaching section, and a carding section wherein said web is cross blended, hydroentangled, bleached and carded.

37. The method of claim 36 to include processing said heated fibers through a precleaning station where said fibers are blended, cleaned, cooled and reheated prior to delivering said fibers to said primary cleaning and web forming station.

* * * * *